US007458159B2

(12) United States Patent
Galyean et al.

(10) Patent No.: US 7,458,159 B2
(45) Date of Patent: Dec. 2, 2008

(54) FOLDING KNIFE HAVING A LOCKING MECHANISM

(75) Inventors: Timothy James Galyean, Canby, OR (US); Kenneth J. Onion, Kaneohe, HI (US); Craig Green, Sherwood, OR (US)

(73) Assignee: Kai U.S.A., Ltd., Tualatin, OR (US)

( * ) Notice: Subject to any disclaimer, the term of this patent is extended or adjusted under 35 U.S.C. 154(b) by 145 days.

(21) Appl. No.: 11/273,638

(22) Filed: Nov. 14, 2005

(65) Prior Publication Data

US 2006/0174490 A1 Aug. 10, 2006

Related U.S. Application Data

(60) Provisional application No. 60/630,601, filed on Nov. 12, 2004.

(51) Int. Cl.
*B26B 1/04* (2006.01)

(52) U.S. Cl. ..... 30/160; 30/159

(58) Field of Classification Search ..... 30/155, 30/158, 159, 160, 161, 330, 331, 519
See application file for complete search history.

(56) References Cited

U.S. PATENT DOCUMENTS

| | | | | |
|---|---|---|---|---|
| 23,975 | A | 5/1859 | Belcher | 30/160 |
| 57,902 | A | 9/1866 | Hibbard | 30/162 |
| 226,910 | A | 4/1880 | Friebertshauser | |
| 338,251 | A | 3/1886 | Crandall et al. | 30/161 |
| 382,967 | A | 5/1888 | Fullerton | 451/309 |
| 530,792 | A | 12/1894 | Nordlow | 30/159 |
| 551,052 | A | 12/1895 | Shonnand et al. | 30/159 |
| 552,928 | A | 1/1896 | Russell | 30/159 |
| 557,760 | A | 4/1896 | Brauer | 30/159 |
| 577,593 | A | 2/1897 | Bronson et al. | 16/293 |
| 600,442 | A | 3/1898 | Nell | 30/159 |
| 616,689 | A | 12/1898 | Ruettgers | |
| 749,230 | A | 1/1904 | Severance | 30/160 |
| 777,358 | A | 12/1904 | Weck | |
| 825,976 | A | 7/1906 | Neiglick | 30/162 |

(Continued)

FOREIGN PATENT DOCUMENTS

| | | |
|---|---|---|
| DE | 29469 | 6/1884 |

(Continued)

*Primary Examiner*—Hwei-Siu C Payer
(74) *Attorney, Agent, or Firm*—Seed IP Law Group PLLC

(57) ABSTRACT

A folding knife includes a handle and a blade attached thereto and configured to rotate between an open position and a closed position. A locking element is coupled to the handle, while a pawl is coupled to the blade and configured to engage the locking element as the blade rotates to the closed position, such that the blade is locked in the closed position thereby. Opening pressure on the pawl causes it to release the locking element and also causes the blade to rotate from the closed position toward the open position. The knife blade may include a flicker positioned to extend from a back portion of the handle when the blade is in the closed position. The pawl is coupled to the flicker such that pressure on the flicker causes the pawl to release the locking moves the blade toward the open position. The folding knife may also include an opening assist mechanism.

14 Claims, 7 Drawing Sheets

U.S. PATENT DOCUMENTS

| | | | | |
|---|---|---|---|---|
| 845,792 | A | 3/1907 | Jenkins | 30/162 |
| 969,909 | A | 9/1910 | Schrade et al. | 30/159 |
| 1,057,525 | A | 4/1913 | Bruecker | 30/162 X |
| 1,189,005 | A | 6/1916 | Seely | 30/161 X |
| 1,315,503 | A | 9/1919 | Hughes | |
| 1,315,901 | A | 9/1919 | Ballinger | |
| 1,319,532 | A | 10/1919 | Rasmussen | |
| 1,357,398 | A | 11/1920 | Haywood | 30/161 |
| 1,412,373 | A | 4/1922 | Shields | 30/159 |
| 1,417,872 | A | 5/1922 | Wall | 30/162 |
| 1,440,793 | A | 1/1923 | Rasmussen | |
| 1,454,665 | A | 5/1923 | Bobek | 30/161 |
| 1,496,188 | A | 6/1924 | Wall | 30/162 |
| 1,515,688 | A | 11/1924 | Love | 30/308.2 |
| 1,584,165 | A | 5/1926 | Brown | 30/159 |
| 1,603,914 | A | 10/1926 | Hermann | |
| 1,614,949 | A | 1/1927 | Finley | 30/161 X |
| 1,701,027 | A | 2/1929 | Brown | |
| 1,738,496 | A | 12/1929 | Laux | 30/162 X |
| 1,743,022 | A | 1/1930 | Carman | |
| 1,810,031 | A | 6/1931 | Schrade | 30/159 |
| 1,864,011 | A | 6/1932 | Brown | |
| 2,284,168 | A | 5/1942 | Rickenbacher | 30/162 |
| 2,286,524 | A | 6/1942 | Wilbur | 30/161 |
| D137,408 | S | 3/1944 | Frisk | |
| 2,407,897 | A | 9/1946 | Newman | 30/159 |
| 2,455,765 | A | 12/1948 | Harvey | 248/360 |
| 2,736,959 | A | 3/1956 | Simon et al. | 30/123 |
| 3,079,784 | A | 3/1963 | Parlowski | 70/456 |
| 3,404,456 | A | 10/1968 | Chilko | 30/155 |
| 3,868,774 | A | 3/1975 | Miori | 30/161 |
| 4,040,181 | A | 8/1977 | Johnson | 30/161 |
| 4,133,106 | A | 1/1979 | Addis | 30/160 |
| 4,148,140 | A | 4/1979 | Lile | 30/161 |
| 4,173,068 | A | 11/1979 | Cargill | 30/161 |
| 4,211,003 | A | 7/1980 | Collins | 30/162 |
| 4,218,819 | A | 8/1980 | Phelps | 30/157 |
| 4,240,201 | A | 12/1980 | Sawby et al. | 30/161 |
| 4,268,960 | A | 5/1981 | Reinschreiber | 30/161 |
| 4,274,200 | A | 6/1981 | Coder | 30/161 |
| 4,322,885 | A | 4/1982 | Osada | 30/162 |
| 4,347,665 | A | 9/1982 | Glesser | 30/161 |
| 4,356,631 | A | 11/1982 | Guth | 30/154 |
| 4,389,775 | A | 6/1983 | Collins | 30/156 |
| 4,404,748 | A | 9/1983 | Wiethoff | 30/161 |
| 4,426,779 | A | 1/1984 | Morgan | 30/138 |
| 4,439,922 | A | 4/1984 | Sassano | 30/161 |
| 4,442,600 | A | 4/1984 | Felix-Dalichow | 30/161 |
| 4,451,982 | A | 6/1984 | Collins | 30/161 |
| 4,466,561 | A | 8/1984 | Slaughter | 224/163 |
| 4,481,712 | A | 11/1984 | Phelps | 30/151 |
| 4,494,309 | A | 1/1985 | Gray | 30/151 |
| 4,494,310 | A | 1/1985 | Slaughter | 30/155 |
| 4,502,221 | A | 3/1985 | Pittman | 30/160 |
| 4,525,928 | A | 7/1985 | Foster | 30/158 |
| 4,529,111 | A | 7/1985 | Hayakawa | 224/163 |
| 4,541,175 | A | 9/1985 | Boyd et al. | 30/161 |
| 4,541,556 | A | 9/1985 | Collins et al. | 224/196 |
| 4,561,577 | A | 12/1985 | Moore | 224/232 |
| 4,570,341 | A | 2/1986 | Konneker | 30/161 |
| 4,600,133 | A | 7/1986 | Maihos | 224/232 |
| 4,604,803 | A | 8/1986 | Sawby | 30/161 |
| 4,612,706 | A | 9/1986 | Yunes | 30/160 |
| 4,670,984 | A | 6/1987 | Rickard | 30/161 |
| 4,719,700 | A | 1/1988 | Taylor, Jr. | 30/158 |
| 4,741,106 | A | 5/1988 | Yamagishi | 30/161 |
| 4,776,094 | A | 10/1988 | Glesser | 30/160 |
| 4,802,279 | A | 2/1989 | Rowe | 30/155 |
| 4,805,303 | A | 2/1989 | Gibbs | 30/161 |
| 4,805,819 | A | 2/1989 | Collins | 224/232 |
| 4,811,486 | A | 3/1989 | Cunningham | 30/161 |
| 4,837,932 | A | 6/1989 | Elsener | 30/161 |
| 4,848,000 | A | 7/1989 | O'Dell | 30/158 |
| 4,893,409 | A | 1/1990 | Poehlmann | 30/161 |
| 4,896,424 | A | 1/1990 | Walker | 30/349 |
| 4,909,424 | A | 3/1990 | Reynolds | 224/232 |
| 4,918,820 | A * | 4/1990 | Korb et al. | 30/161 |
| 4,947,552 | A | 8/1990 | Barnes | 30/161 |
| 4,974,323 | A | 12/1990 | Cassady | 30/155 |
| 4,979,301 | A | 12/1990 | Walker | 30/161 |
| 5,044,079 | A | 9/1991 | Gibbs | 30/160 |
| 5,060,379 | A | 10/1991 | Neely | 30/161 |
| 5,092,045 | A | 3/1992 | Boyd, Jr. et al. | 30/161 |
| 5,095,624 | A | 3/1992 | Ennis | 30/161 |
| 5,111,581 | A | 5/1992 | Collins | 30/161 |
| 5,123,167 | A | 6/1992 | Kelley | 30/151 |
| 5,131,149 | A | 7/1992 | Thompson et al. | 30/161 |
| D333,251 | S | 2/1993 | Glesser | D8/99 |
| D336,602 | S | 6/1993 | Thompson et al. | D8/99 |
| 5,217,150 | A | 6/1993 | Chen | 224/163 |
| 5,217,151 | A | 6/1993 | Parsons | 224/253 |
| D345,289 | S | 3/1994 | Sakai | D8/99 |
| 5,293,690 | A | 3/1994 | Cassady | 30/161 |
| D348,599 | S | 7/1994 | Sakai | D8/99 |
| 5,325,588 | A | 7/1994 | Rogers | 30/161 |
| 5,331,741 | A | 7/1994 | Taylor, Jr. | 30/158 |
| 5,349,753 | A | 9/1994 | Gaffney | 30/155 |
| 5,361,497 | A | 11/1994 | Crawford | 30/155 |
| 5,400,509 | A | 3/1995 | Collins | 30/161 |
| 5,425,175 | A | 6/1995 | Rogers | 30/161 |
| 5,437,101 | A | 8/1995 | Collins | 30/153 |
| 5,450,670 | A | 9/1995 | Sakai | 30/298.4 |
| 5,461,786 | A | 10/1995 | Miller | 30/161 |
| D366,408 | S | 1/1996 | Sessions et al. | D8/99 |
| 5,493,781 | A | 2/1996 | Saito | 30/162 |
| 5,495,674 | A * | 3/1996 | Taylor, Jr. | 30/160 |
| 5,502,895 | A | 4/1996 | Lemaire | 30/158 |
| 5,511,310 | A | 4/1996 | Sessions et al. | 30/161 |
| 5,511,311 | A | 4/1996 | Collins | 30/162 |
| 5,515,610 | A | 5/1996 | Levin et al. | 30/161 |
| 5,537,750 | A | 7/1996 | Seber et al. | 30/161 |
| 5,546,662 | A | 8/1996 | Seber et al. | 30/161 |
| D373,296 | S | 9/1996 | Thompson | |
| D373,716 | S | 9/1996 | Keys et al. | D8/107 |
| 5,581,895 | A | 12/1996 | Jeffcoat | 30/294 |
| 5,596,808 | A | 1/1997 | Lake et al. | 30/161 |
| 5,615,484 | A | 4/1997 | Pittman | 30/161 |
| 5,647,129 | A | 7/1997 | Stamper | 30/139 |
| D385,173 | S | 10/1997 | McWillis | D8/99 |
| 5,685,079 | A | 11/1997 | Brothers et al. | 30/161 |
| 5,689,885 | A | 11/1997 | Walston | 30/160 |
| 5,692,304 | A | 12/1997 | Campbell | 30/161 |
| 5,699,615 | A | 12/1997 | Chen | 30/160 |
| D392,538 | S | 3/1998 | Buck et al. | D8/99 |
| D392,539 | S | 3/1998 | Balolia | D8/99 |
| 5,737,841 | A | 4/1998 | McHenry et al. | 30/161 |
| 5,755,035 | A | 5/1998 | Weatherly | 30/161 |
| 5,781,998 | A | 7/1998 | Stamper | 30/139 |
| 5,802,722 | A | 9/1998 | Maxey et al. | 30/160 |
| D399,113 | S | 10/1998 | Balolia | D8/99 |
| 5,815,927 | A | 10/1998 | Collins | 30/161 |
| 5,819,414 | A | 10/1998 | Marifone | 30/160 |
| 5,822,866 | A | 10/1998 | Pardue | 30/161 |
| 5,822,867 | A | 10/1998 | Sakai | 30/298.4 |
| 5,826,340 | A | 10/1998 | Hull | 30/161 |
| 5,839,194 | A | 11/1998 | Bezold | 30/161 |
| 5,845,404 | A | 12/1998 | Jeffcoat | 30/125 |
| D407,003 | S | 3/1999 | Macowski et al. | D8/99 |
| 5,875,552 | A | 3/1999 | Chen | 30/161 |
| 5,878,500 | A | 3/1999 | Emerson | 30/158 |
| 5,887,347 | A | 3/1999 | Gibbs | 30/161 |
| 5,915,792 | A * | 6/1999 | Sakurai | 30/161 |
| 5,964,036 | A | 10/1999 | Centofante | 30/161 |
| 5,966,816 | A | 10/1999 | Roberson | 30/156 |

| | | | | |
|---|---|---|---|---|
| D422,479 | S | 4/2000 | Pardue | D8/99 |
| 6,079,106 | A | 6/2000 | Vallotton | 30/161 |
| 6,088,860 | A * | 7/2000 | Poehlmann et al. | 7/128 |
| 6,122,829 | A | 9/2000 | McHenry et al. | 30/161 |
| 6,125,543 | A | 10/2000 | Jhones | 30/161 |
| 6,145,202 | A | 11/2000 | Onion | 30/160 |
| D434,631 | S | 12/2000 | Lum | D8/99 |
| 6,154,965 | A | 12/2000 | Sakai | 30/161 |
| 6,158,127 | A | 12/2000 | Taylor | 30/158 |
| D438,085 | S | 2/2001 | Onion | D8/99 |
| 6,256,888 | B1 | 7/2001 | Shuen | 30/161 |
| 6,276,063 | B1 | 8/2001 | Chen | 30/161 |
| 6,289,592 | B1 | 9/2001 | Emerson | 30/161 |
| 6,308,420 | B1 | 10/2001 | Moser | 30/161 |
| 6,338,431 | B1 | 1/2002 | Onion | 230/161 |
| 6,363,615 | B1 | 4/2002 | Moser | |
| 6,378,214 | B1 | 4/2002 | Onion | 30/161 |
| 6,397,476 | B1 | 6/2002 | Onion | 30/160 |
| 6,397,477 | B1 | 6/2002 | Collins | 30/161 |
| 6,427,334 | B2 | 8/2002 | Onion | 30/161 |
| 6,427,335 | B1 | 8/2002 | Ralph | 30/161 |
| 6,430,816 | B2 | 8/2002 | Neveux | 30/161 |
| 6,434,831 | B2 | 8/2002 | Chen | 30/161 |
| 6,438,848 | B1 | 8/2002 | McHenry et al. | 30/161 |
| D462,581 | S | 9/2002 | Parlowski | D7/649 |
| D462,582 | S | 9/2002 | Parlowski | D7/649 |
| 6,442,843 | B1 | 9/2002 | Jue et al. | 30/151 |
| 6,490,797 | B1 | 12/2002 | Lake et al. | 30/161 |
| 6,553,671 | B2 | 4/2003 | Blanchard | 30/161 |
| 6,574,869 | B1 | 6/2003 | McHenry et al. | 30/161 |
| 6,591,504 | B2 | 7/2003 | Onion | 30/160 |
| 6,651,344 | B2 | 11/2003 | Cheng | 30/159 |
| 6,732,436 | B2 | 5/2004 | Moizis | 30/155 |
| D498,985 | S | 11/2004 | Kerr et al. | D7/649 |
| 6,810,588 | B1 | 11/2004 | Cheng | |
| 6,918,184 | B2 * | 7/2005 | Glesser | 30/161 |
| 7,059,053 | B2 * | 6/2006 | Sakai | 30/160 |
| 2002/0000042 | A1 | 1/2002 | Glesser et al. | 30/160 |
| 2002/0157260 | A1 | 10/2002 | Cheng | 30/161 |
| 2003/0070299 | A1 | 4/2003 | Frazer | 30/161 |
| 2003/0089750 | A1 | 5/2003 | Martinez | 224/232 |
| 2004/0020058 | A1 | 2/2004 | Vallotton | 30/160 |
| 2004/0158991 | A1 | 8/2004 | Freeman | |
| 2005/0097754 | A1 | 5/2005 | Onion | 30/159 |
| 2005/0172497 | A1 * | 8/2005 | Linn et al. | 30/161 |

FOREIGN PATENT DOCUMENTS

| | | |
|---|---|---|
| DE | 1 104 386 | 4/1961 |
| EP | 0 230 000 | 7/1987 |
| FR | 493 741 | 8/1919 |
| FR | 1 069 862 | 7/1954 |
| FR | 1 171 740 | 1/1959 |
| FR | 1 248 117 | 10/1960 |
| FR | 2 705 606 | 12/1994 |
| JP | 3-227601 | 10/1991 |
| JP | 4-030979 | 2/1992 |

* cited by examiner

FOLDING KNIFE HAVING A LOCKING MECHANISM

CROSS-REFERENCE TO RELATED APPLICATION

This application claims the benefit under 35 U.S.C. § 119 (e) of U.S. Provisional Patent Application No. 60/630,601 filed Nov. 12, 2004, which is incorporated herein by reference in its entirety.

BACKGROUND OF THE INVENTION

1. Field of the Invention

The present disclosure relates generally to a folding knife, and in particular to a folding knife having a locking mechanism for locking the knife blade in the closed position.

2. Description of the Related Art

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle, and a closed position in which the blade is at least partially received within the handle. Many folding knives also include a locking mechanism to maintain the blade in the open position and/or the closed position.

Examples of folding knives, including folding knives with locking mechanisms, may be found in U.S. Pat. Nos. 1,454,665; 1,743,022; 4,040,081; 4,173,068; 4,404,748; 4,451,982; 4,502,221; 4,719,700; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741; 5,425,175; 5,502,895; 5,515,610; 5,537,750; 5,546,662; 5,596,808; 5,615,484; 5,685,079; 5,689,885; 5,692,304; 5,737,841; 5,755,035; 5,802,722; 5,822,866; 5,826,340; 5,887,347; 5,964,036; 6,079,106; 6,154,965; 6,338,431; 6,378,214; 6,427,335; 6,438,848; 6,490,797; D348,599, and D373,296; and U.S. patent application Ser. Nos. 2002/0157260 and 2003/0070299, the entire disclosures of which are herein incorporated by reference for all purposes.

BRIEF SUMMARY OF THE INVENTION

According to an embodiment of the invention, a folding knife is provided, comprising a handle having a blade receiving channel and a blade pivotably attached to the handle and configured to rotate, relative to the handle, between an open position, in which the blade extends from the handle, and a closed position, in which a portion of the blade is received in the blade receiving channel. A locking element is coupled to the handle, while a pawl is coupled to the blade and configured to engage the locking element as the blade rotates to the closed position, such that the blade is locked in the closed position thereby.

The pawl is positioned such that opening pressure thereon causes the pawl to release the locking element and also causes the blade to rotate from the closed position toward the open position.

According to an embodiment, the knife blade includes a flicker positioned to extend from a back portion of the handle when the blade is in the closed position such that pressure on the flicker biases the blade toward the open position. The pawl is coupled to the flicker such that pressure on the flicker causes the pawl to release the locking element and also causes the blade to rotate from the closed position toward the open position. A bias element coupled between the pawl and the handle is configured to bias the pawl toward the locking position.

According to another embodiment, the folding knife also includes an opening assist mechanism configured to apply an opening bias to the blade when the blade is moved beyond an intermediate position. In embodiments that include both the bias element and the flicker, the intermediate position is located such that, when the blade is rotated from the closed position toward the open position, the blade reaches the intermediate position before the flicker is fully received into the handle.

BRIEF DESCRIPTION OF THE SEVERAL VIEWS OF THE DRAWING(S)

In the drawings, identical reference numbers identify similar elements or acts.

DETAILED DESCRIPTION OF THE INVENTION

Figure 1:
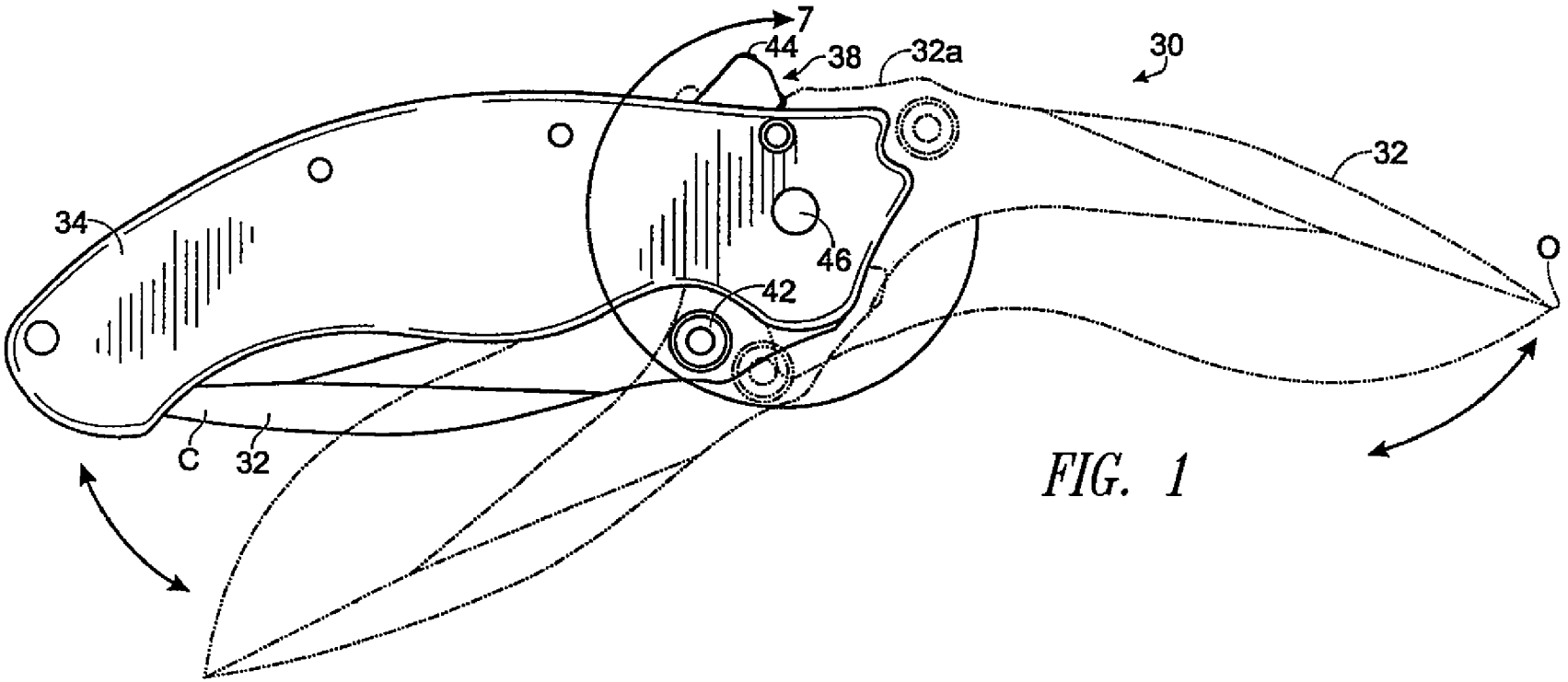
FIG. 1 is a side view of a folding knife incorporating a locking mechanism according to an embodiment of the invention.

In the following description, certain specific details are set forth in order to provide a thorough understanding of various embodiments of the invention. However, one skilled in the art will understand that the invention may be practiced without these details. In other instances, well-known structures associated with motors, motor controllers, computers, microprocessors, memories and the like have not been shown or described in detail to avoid unnecessarily obscuring descriptions of the embodiments of the invention.

FIGS. 1-10 depict an embodiment of a folding knife 30 having a blade 32, a handle 34 defining a blade-receiving channel 36, and a locking mechanism 38. Blade 32 includes a tang 32*a* that is pivotally connected to handle 34. The blade pivots with respect to the handle about a pivot axis P between an open position O and a closed position C. In the open position, the blade extends away from the handle, where it is deployed and ready for use. From the open position, the blade may be folded towards the handle, pivoting about pivot axis P, into the closed position, in which the blade is at least partially received for storage within blade-receiving channel 36. In the closed position, blade 32 extends along handle 34.

Figure 5:
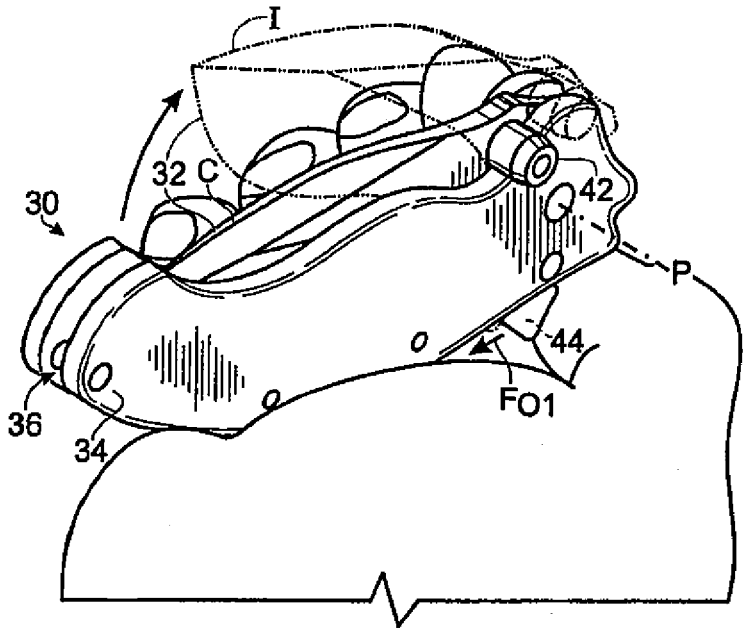
FIG. 5 is an isometric view showing a user's hand positioned for opening the blade of the knife of FIG. 1 via a flicker on the blade.
Figure 6:
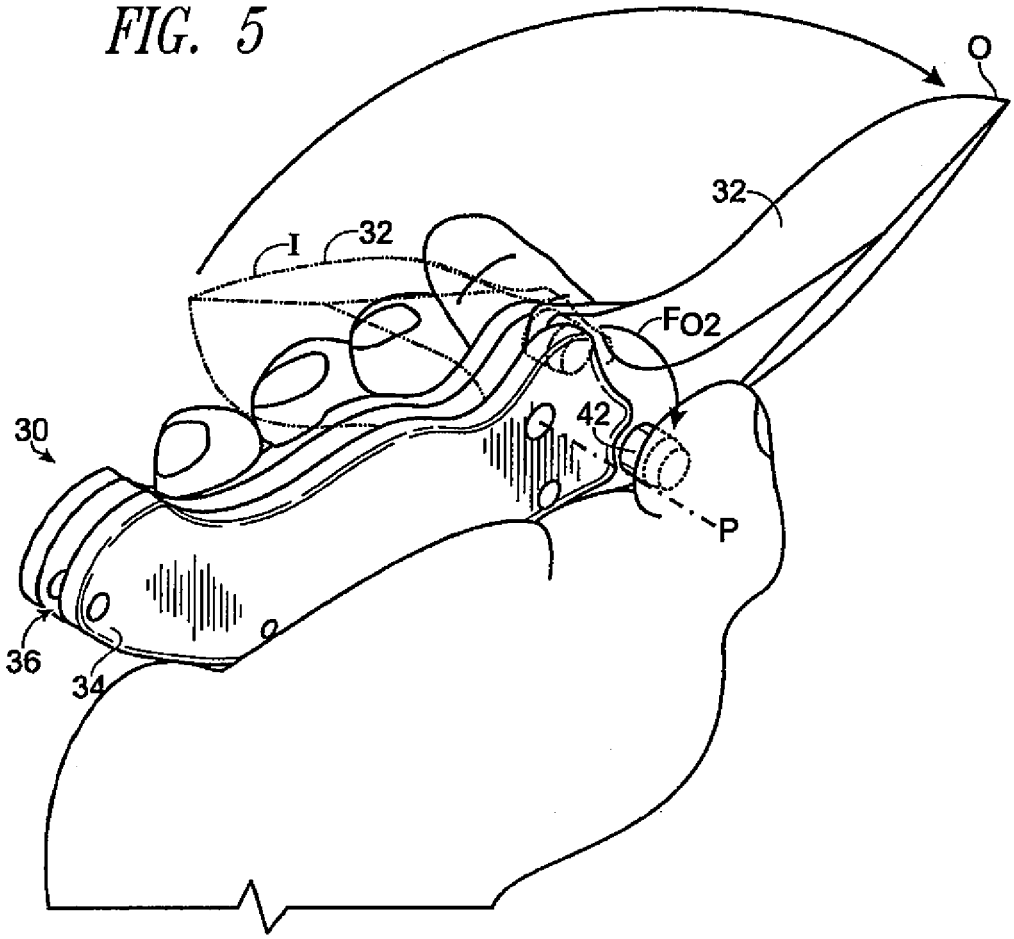
FIG. 6 is an isometric view showing the user's hand positioned for completing the opening of the blade of the knife of FIG. 1 via a post on the blade.

Blade 32 includes a manipuable portion configured to assist a user in opening the blade. In the embodiment shown, the manipulable portion is in the form of a flicker 44 configured to be manipuable from outside the handle 34 when the blade is in the closed position C. A user applies a first opening force $Fo_1$ to push flicker portion 44 into the handle, thereby pivoting the blade into an intermediate position I, as shown in FIG. 5. The user may then pivot the blade into the open position by applying a second opening force $Fo_2$ on post 42, as shown in FIG. 6, or on any suitable location on blade 32. Although the manipulable portions in FIGS. 3-6 are shown to be moved by the user's thumb, those portions may be moved by any other suitable part of the user, such as the user's index finger.

The manipulable portion is described as being a flicker. However, the manipulable portion may be in the form of one or more posts, such as post 42 shown in FIGS. 1-4. Other examples of manipulable portions include one or more holes in the blade, one or more ridges on the blade, etc.

Figure 2:
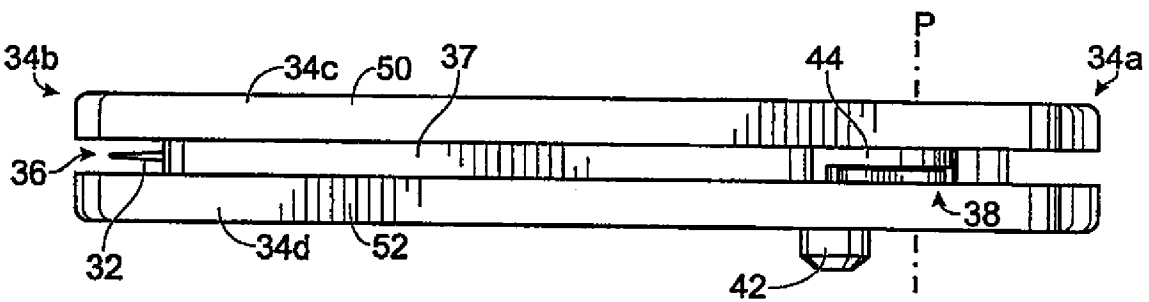
FIG. 2 is a plan view of the knife of FIG. 1.
Figure 3:
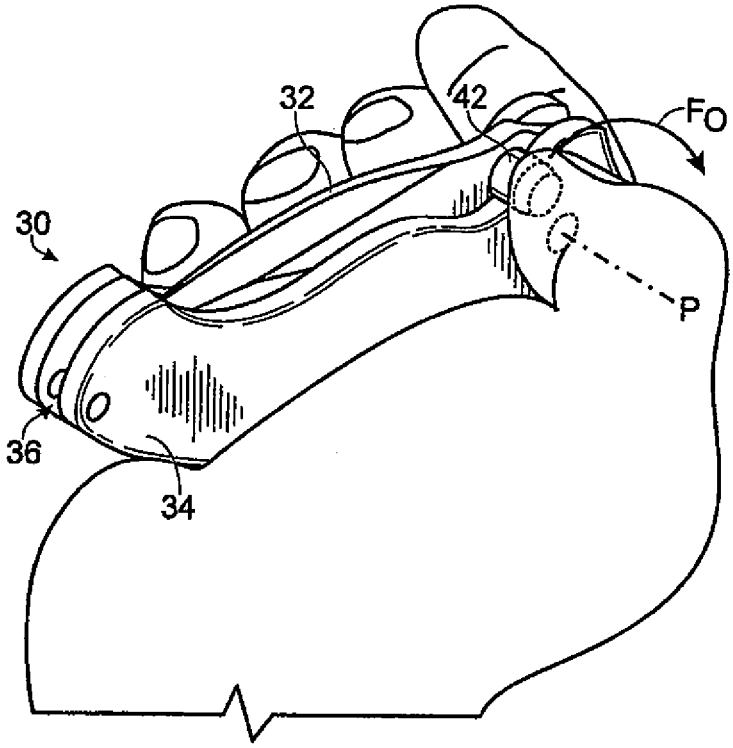
FIG. 3 is an isometric view showing a user's hand positioned for opening the blade of the knife of FIG. 1 via a post on the blade.
Figure 4:
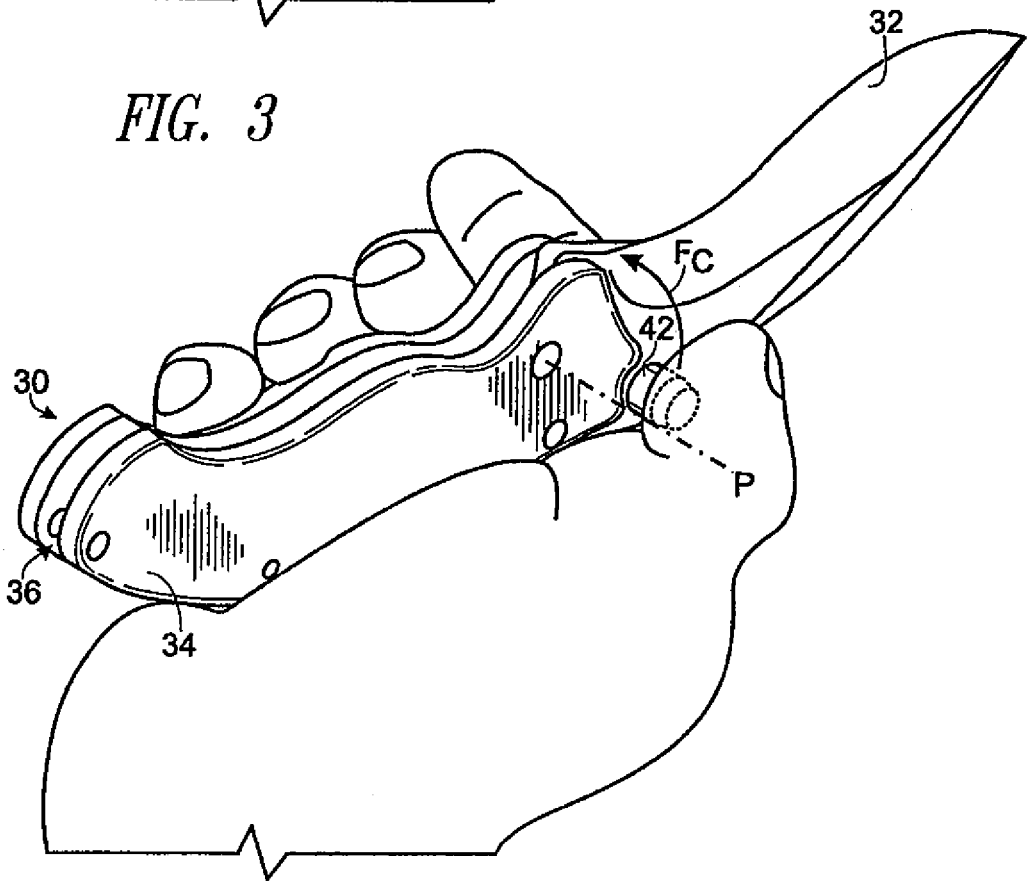
FIG. 4 is an isometric view showing a user's hand positioned for closing the blade of the knife of FIG. 1 via a post on the blade.

Handle 34 includes a pivot-end portion 34*a*, an opposing-end portion 34*b*, and first and second handle sides 34*c* and 34*d*, as shown in FIG. 2. Tang 32*a* of blade 32 is pivotally connected to handle 34 at pivot-end portion 34*a* via a pivot pin 46. Additionally, blade stop 48 is mounted between handle sides 34*c* and 34*d* and is configured to stop blade 32 from pivoting beyond the closed position C as it rotates closed, or beyond the open position O as it rotates open. Handle sides 34*c* and 34*d* also include respective handle side panels 50 and 52. Handle side panels 50 and 52 may be any suitable shape or structure configured to facilitate gripping or handling of knife 30. Although handle side panels 50 and 52 are shown to have specific shapes, any suitable shape may be used.

Additionally, handle 34 may include one or more handle liners (not shown), which may be any suitable shape or structure and may conform to the shape of handle side panels 50 and 52. Although the knife discussed and shown in FIGS. 1-2 includes two handle side panels, any combination of handle side panels and liners may be used. Furthermore, handle 34 may include one or more spacers 37, which may be any suitable shape or structure and may conform to the shape of handle side panels 50 and 52. Although the knife discussed includes one spacer, any suitable number of spacers may be used.

Locking mechanism 38 includes a first locking element 54 and a second locking element 56, as shown in FIGS. 7-10. First locking element 54 includes a structure configured to engage second locking element 56 and lock blade 32 in the closed position. According to an alternate embodiment, the first locking element may also be configured to automatically engage second locking element 56 when blade 32 is pivoted to open position O.

As shown in FIGS. 7-10, first locking element 54 includes a locking member, or pawl, 58 pivotally connected to flicker 44 of blade 32. Locking member 58 pivots around an engagement axis E via a locking member pin 59. The locking member 58 pivots between a locking position L in which locking member 58 engages second locking element 56 to lock blade 32 in the closed position, and an unlocking position U in which locking member 58 is spaced away from second locking element 56 to free blade 32 to pivot towards open position O.

Figure 7:
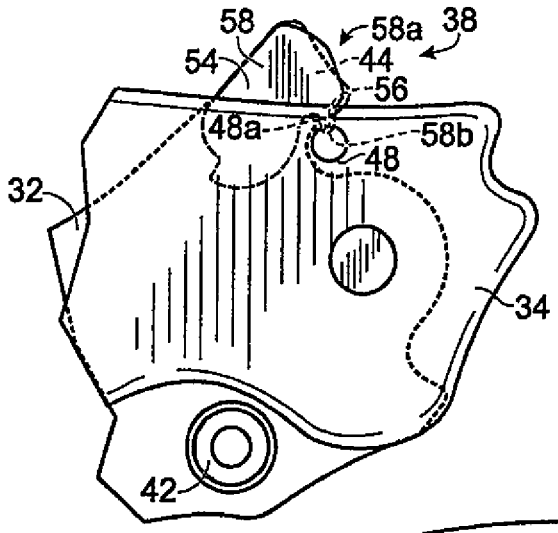
FIG. 7 is a partial side view of the knife of FIG. 1 showing the locking mechanism.
Figure 8:
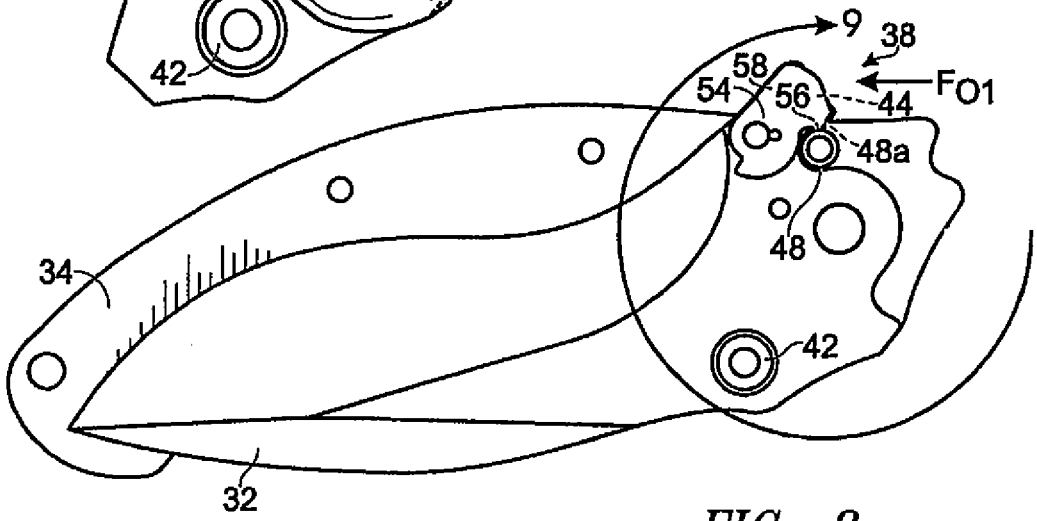
FIG. 8 is a side view of the knife of FIG. 1, shown without a handle side to illustrate the blade in the closed position and the locking mechanism.
Figure 9:
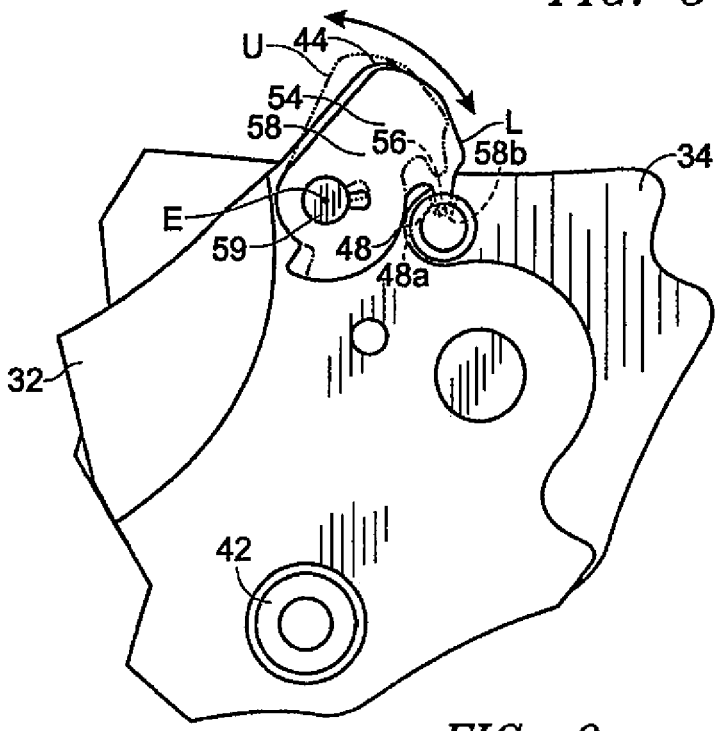
FIG. 9 is a partial side view of FIG. 8 showing the locking mechanism.

The locking member 58 substantially conforms to the shape of the flicker 44 except for a protruding portion 58*a* and engaging portion 58*b*, as shown in FIG. 7. The protruding portion 58*a* is configured to allow a user to pivot locking member 58 to the unlocking position by applying first opening force $Fo_1$ on flicker 44. Thus, a user may both unlock locking member 58 and move the blade towards the open position by applying, concurrently or sequentially, an opening force on flicker 44 and locking member 58 in a continuous motion. The engaging portion is configured to engage at least part of second locking element 56 and lock the blade in the closed position.

Although the locking member 58 is shown to include a specific shape and structure, any suitable shape and structure configured to engage the second locking element 56 and lock the blade in the closed position is acceptable. Additionally, although locking member 58 is shown to be pivotally connected, any suitable connection may be used, that is configured to enable locking member 58 to move between locking position L and unlocking position U, such as sliding connections, etc. Furthermore, although the locking member 58 is shown to be pivotally connected to flicker 44, the locking member may be connected to any suitable manipuable portion configured to allow the locking member to engage second locking element 56 when the blade is in the closed position. For example, locking member 58 may be slidingly connected to post 42 or to any other manipulable portion. Optionally, second locking element 56 may be manipuable and/or movable relative to first locking element 54, which in turn must be either fixed or movable.

First locking element 54 also may include a bias element 60, which may include any suitable resilient structure configured to urge locking member 58 towards locking position L. For example, in the embodiment of FIG. 10, bias element 60 is in the form of a coiled spring 62. The coiled spring includes a first end 62*a* and a second end 62*b*. The first end is captured on locking member 58 via notch 58*c*, while the second end is captured on flicker 44 via notch 44*a*. Coiled spring 62 is configured to urge locking member 58 towards locking position L. Thus, when blade 32 is pivoted to the closed position, locking member 58, via bias element 60, automatically engages second locking element 56. Therefore, locking mechanism 38 automatically locks the blade when the blade is pivoted to the closed position.

Figure 10:
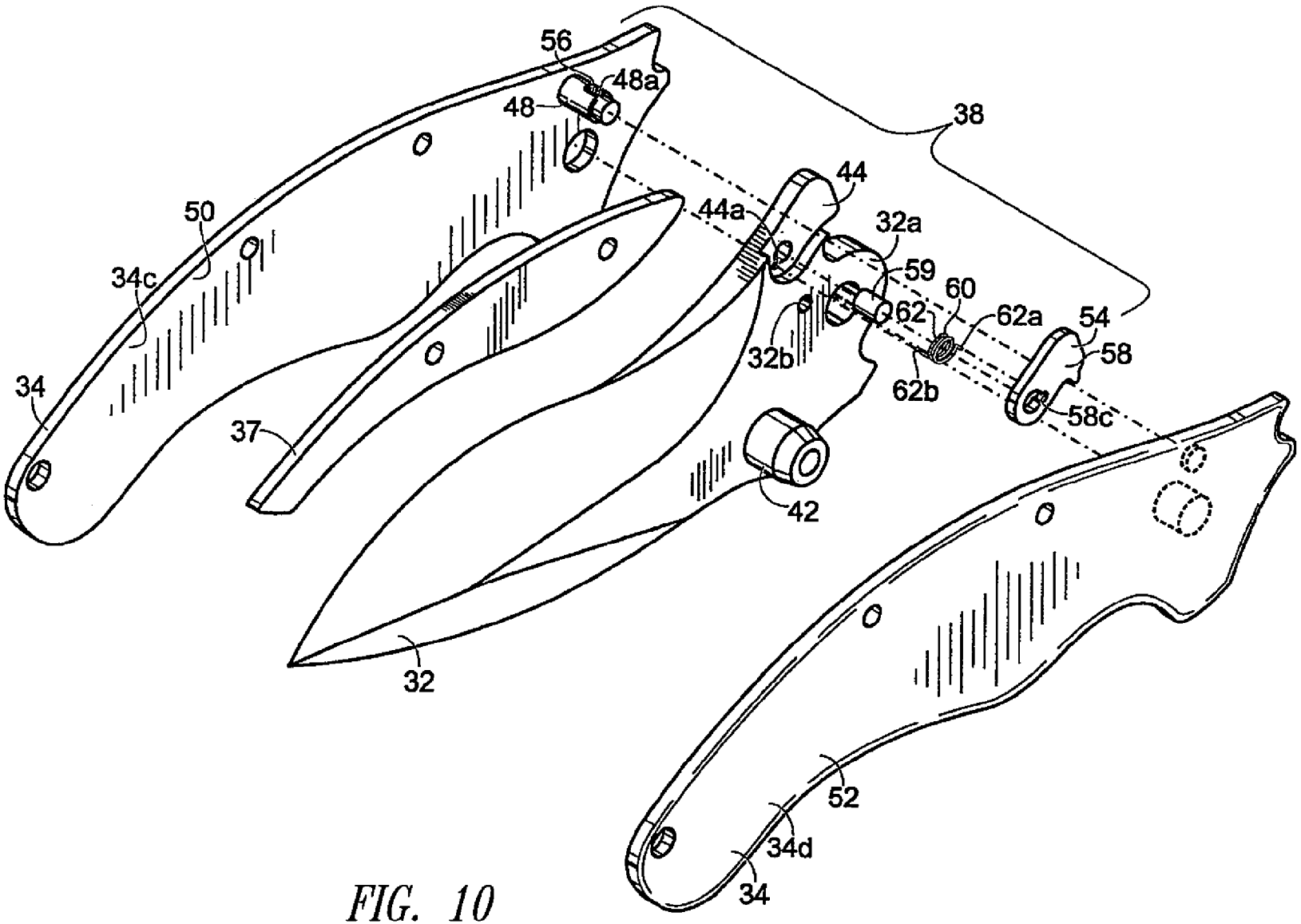
FIG. 10 is an exploded view of the knife of FIG. 1.

Although bias element 60 is depicted in FIG. 10 as a coiled spring, it may be of any suitable type of bias element configured to urge locking member 58 towards the locking position, such as wire springs, leaf springs, music wire, or other resilient material or structure. Additionally, although bias element 60 is shown to be connected to flicker 44 and locking member 58 via notches 44*a* and 58*c*, respectively, the bias element may be connected to the flicker and the locking member in any suitable way configured to allow bias element to urge locking member 58 towards the locking position. Furthermore, although first locking element 54 is discussed as including locking member 58, any other suitable structure may be used, such as latches or hooks, or mechanical, magnetic, or electronic devices, or the like, configured to engage at least part of second locking element 56 and lock blade 32 in closed position C.

Figure 13:
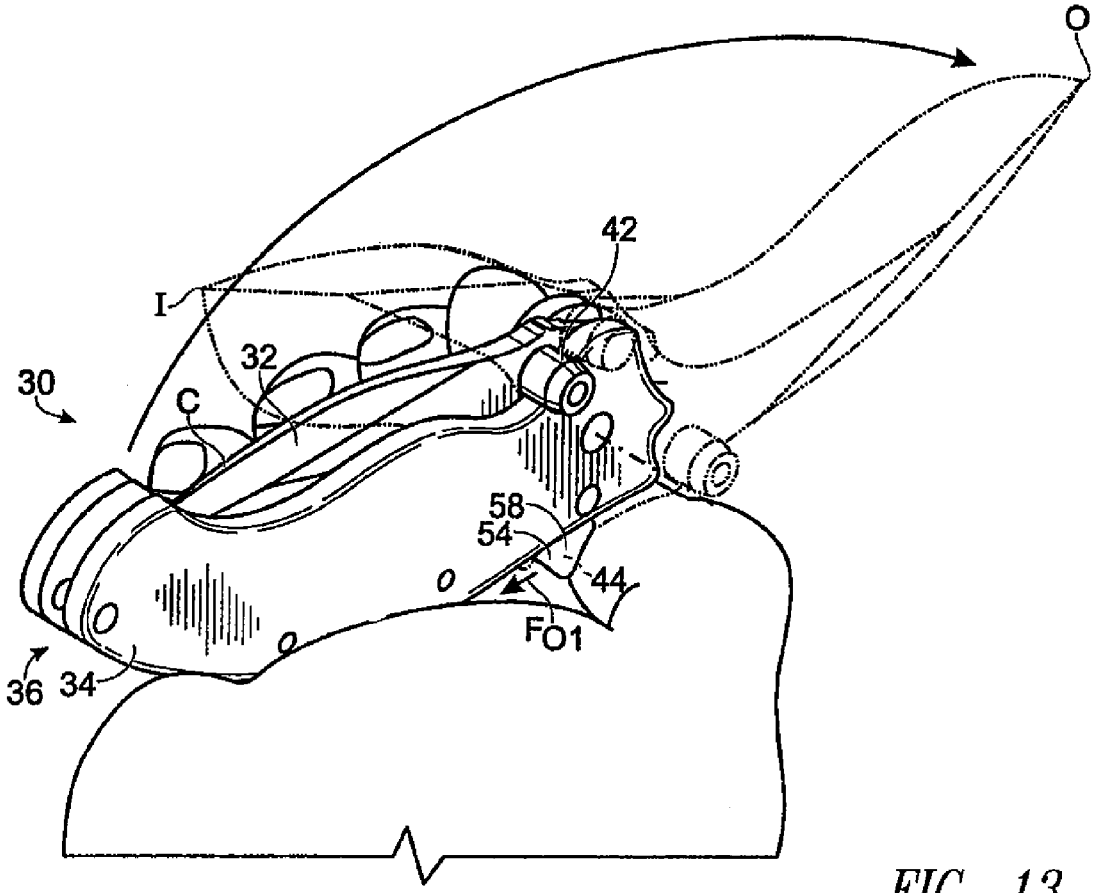
FIG. 13 is an isometric view showing a user's hand positioned for opening the blade of the knife of FIG. 11 via a flicker on the blade.

In operation, the first locking element 54 is configured to be disengaged from second locking element 56 by the same motion or force used to pivot the blade towards open position O, as also described with reference to FIGS. 5 and 13. Pressure by the user's finger on the flicker 44 is applied first on the protruding portion 58*a* of the locking member 58, which rotates until the protruding portion 58*a* is flush with the corresponding surface of the flicker 44. When the locking member 58 rotates, the engaging portion 58*b* is withdrawn from the second locking element 56, unlocking the blade. At this point the pressure moves the blade out of the blade receiving channel 36 and moves it toward the intermediate position I, and thence to the open position O.

When the blade 32 is rotated from the open position O to the closed position C, the engaging portion 58*b* of the locking member 58 contacts the blade stop 48, causing the locking member 58 to rotate to permit the blade 32 to continue toward the closed position C. When the blade reaches the closed position C, engaging portion 58*b* drops into the groove 48*a* in the manner of a pawl or ratchet, thereby locking the blade in the closed position.

Second locking element 56 may include any structure configured to engage at least part of first locking element 54 and lock blade 32 in the closed position. For example, in the embodiment shown in FIGS. 9-10, the second locking element is in the form of a groove 48*a* on blade stop 48 that is configured to receive engaging portion 58*b* of locking member 58, thereby locking blade 32 in the closed position C.

Although second locking element 56 is shown to include groove 48*a*, any other suitable structure configured to interact with at least part of the first locking element 54 to lock blade 32 in the closed position may be used, such as latching elements, locking cutouts, holes, notches, or mechanical, magnetic, or electronic devices, or the like. Additionally, although second locking element 56 is shown to be incorporated in blade stop 48, any suitable structure mounted to any part of handle 34 may be used. For example, the second locking element may be incorporated in pivot pin 46 or any other structure. As mentioned, one or both of locking elements 54 and 56 may be movable relative to the other.

Although the locking mechanisms disclosed are shown to be used in folding knives with pivoting blades, the locking mechanisms disclosed may be used for hand-held devices with other types of moving tools that are configured to move relative to a handle between an open position and a closed position.

Knife 30 also may include a blade-assisting mechanism 64, which may include any suitable structure configured to urge blade 32 towards the open position and/or closed position. Examples of blade-assisting mechanisms may be found in U.S. Pat. Nos. 6,145,202; 6,308,420; 6,338,431; 6,378,214; 6,397,476; 6,427,334; and 6,732,436; and U.S. patent application Ser. Nos. 2003/0070299; 2004/0020058; and 2004/0158991, the entire disclosures of which are herein incorporated by reference for all purposes.

Figure 11:
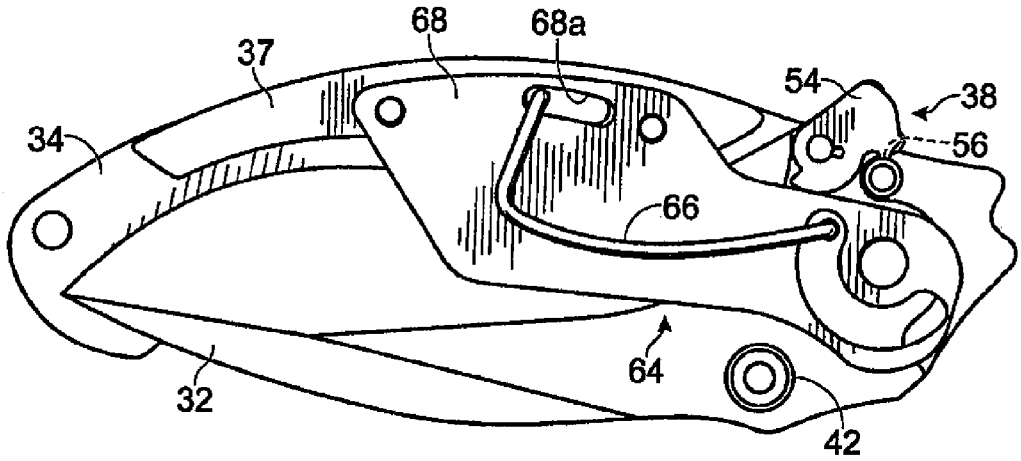
FIG. 11 is a side view of the knife according to an embodiment incorporating a locking mechanism and a blade-assisting mechanism.
Figure 12:
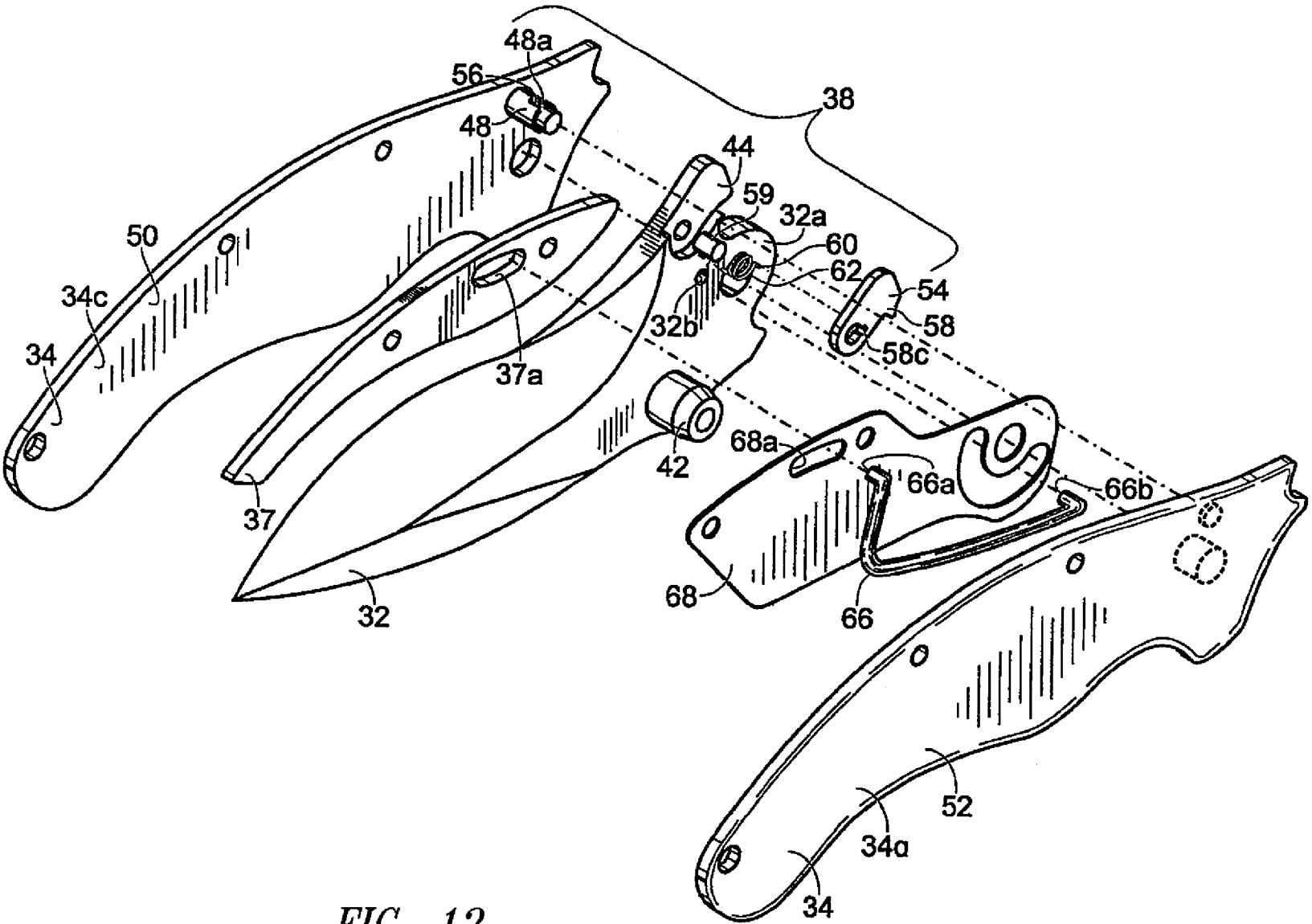
FIG. 12 is an exploded view of the knife of FIG. 11.

An example of a blade-assisting mechanism is shown and described with reference to FIGS. 11-13. The blade-assisting mechanism of the illustrated embodiment includes a bias element 66 and a liner 68. The bias element includes a first end 66*a* and a second end 66*b*. The first end of the bias element is slidingly disposed within a first slot 68*a* of liner 68 and a second slot 37*a* of spacer 37. The second end of the bias element is connected to blade 32 via a hole 32*b*. Although a particular blade-assisting mechanism is described and shown, any suitable blade-assisting mechanism that is configured to urge blade 32 towards the open position and/or closed position over at least a portion of blade travel may be used.

The blade-assisting mechanism allows a user to both unlock locking mechanism 38 and move blade 32 to open position O with the same opening force Fo. For example, as shown in FIG. 13, pushing on flicker 44 with first opening force $Fo_1$ pivots locking member 58 to unlocking position U and moves blade 32 to intermediate position I. Once blade 32 reaches the intermediate position, blade-assisting mechanism 64 is configured to assist pivoting until the blade reaches open position O. Thus, a user may both unlock and move the blade from the closed position to the open position with the same motion or first opening force $Fo_1$. Although the folding knife illustrated in FIGS. 11-13 is shown to include blade-assisting mechanism 64, the folding knife need not include the blade-assisting mechanism.

Another advantage provided by the locking mechanism disclosed above is that the locking mechanism engages automatically when the blade is moved to the closed position. Thus, the blade is securely locked each time it is moved to the closed position, without requiring that the user manually lock the blade after it has been moved to the closed position.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A folding knife, comprising:

a handle having a blade receiving channel;

a blade pivotably attached to the handle and configured to rotate, relative to the handle, between an open position, in which the blade extends from the handle, and a closed position, in which a portion of the blade is received in the blade receiving channel;

a locking element coupled to the handle;

a pawl movably coupled to the blade and configured to engage the locking element as the blade rotates to the closed position such that the blade is locked in the closed position thereby; and a bias element coupled between the pawl and the blade and configured to bias the pawl toward a locking position.

2. The folding knife of claim 1 wherein the pawl is positioned such that opening pressure on the pawl causes the pawl to release the locking element and causes the blade to rotate from the closed position toward the open position.

3. The folding knife of claim 1 wherein the knife blade includes a flicker positioned to extend from a back portion of the handle when the blade is in the closed position such that user-applied pressure on the flicker biases the blade toward the open position.

4. The folding knife of claim 3 wherein the pawl is coupled to the flicker such that pressure on the flicker causes the pawl to release the locking element and causes the blade to rotate from the closed position toward the open position.

5. The folding knife of claim 4 wherein the pawl is rotatably coupled to the flicker and configured to rotate between a locking position and a non-locking position.

6. The folding knife of claim 3, further comprising an opening assist mechanism configured to apply an opening bias to the blade when the blade is moved beyond an intermediate position.

7. The folding knife of claim 6 wherein the intermediate position is located such that, when the blade is rotated from the closed position toward the open position, the blade reaches the intermediate position before the flicker is fully received into the handle.

8. The folding knife of claim 1, further comprising a blade stop coupled to the handle and configured to prevent rotation of the blade beyond the closed position when the blade is rotated from the open position to the closed position.

9. The folding knife of claim 8 wherein the locking element is formed as part of the blade stop.

10. The folding knife of claim 1, further comprising an opening assist mechanism configured to apply an opening bias to the blade when the blade is moved beyond an intermediate position.

11. A folding knife, comprising:

a handle;

a blade pivotably attached to the handle and configured to rotate, relative to the handle, between an open position and a closed position, the blade having a flicker positioned to extend from a back side of the handle while the blade is in the closed position;

a pawl movably coupled to the flicker and configured to engage a locking feature of the handle while the blade is in the closed position and to hold the blade in the closed position while engaging the locking feature; and a bias element coupled to the blade and positioned between the pawl and the flicker, and configured to bias the pawl into engagement with the locking feature.

12. The folding knife of claim 11, further comprising a blade stop extending between sides of the handle and positioned to limit rotation of the blade toward the closed position, the blade stop including the locking feature.

13. The folding knife of claim 12 wherein a tang of the blade is sized and shaped so as to contact the blade stop while in the open position and the closed position.

14. The folding knife of claim 11 wherein the pawl has a shape that substantially conforms to a shape of the flicker, except for a portion that extends beyond the flicker in a position where user-applied pressure on the flicker to move the blade toward the open position moves the pawl away from engagement with the locking feature.

* * * * *